United States Patent [19]

Wassmer et al.

[11] 4,186,836

[45] Feb. 5, 1980

[54] DIFFERENTIAL REFLECTIVITY METHOD AND APPARATUS FOR SORTING INDISCRIMINATELY MIXED ITEMS

[75] Inventors: Norman B. Wassmer; Joseph L. Hodges, both of Ontario, Oreg.

[73] Assignee: Ore-Ida Foods, Inc., Boise, Id.

[21] Appl. No.: 895,256

[22] Filed: Apr. 10, 1978

[51] Int. Cl.[2] ..... B07C 5/344

[52] U.S. Cl. ..... 209/565; 209/587; 209/643

[58] Field of Search ..... 209/565, 587, 643, 580, 209/581, 582, 577

[56] References Cited

U.S. PATENT DOCUMENTS

| | | | |
|---|---|---|---|
| 3,675,769 | 7/1972 | Story | 209/577 |
| 3,762,546 | 10/1973 | Keitel et al. | 209/587 |
| 3,901,388 | 8/1975 | Kelly | 209/587 |
| 3,977,526 | 8/1976 | Gordon et al. | 209/587 |

*Primary Examiner*—Allen N. Knowles

*Attorney, Agent, or Firm*—Mallinckrodt & Mallinckrodt

[57] ABSTRACT

Sorting apparatus and method comprise a viewing area, a removal area, and a conveyor for passing a thin bed of indiscriminately mixed items first through the viewing area and then through the removal area. Radiant energy, which includes bands of two mutually different wavelengths that are reflected in a predetermined relationship by some of the items and in other than that relationship by the other items in the mixture, is flooded into the viewing area as an integrated spread throughout the area from preferably special light fixtures producing both visible light and infrared radiation. A dual diode array, scanning camera has its paired diodes focused, respectively, on contiguous sub-areas of the viewing area across the width of the bed, so the diodes of each pair will sense the different energy wavelengths, respectively, reflected from the corresponding sub-area of the viewing area and so the comparison circuitry of the camera will produce resultant data signals for those diode pairs for which the sensed relationship is the predetermined one. Any resultant data signals are sent to control circuitry arranged to activate corresponding ones of a plurality of devices for removing from the bed as it passes through the removal area, width portions thereof corresponding to the widths and locations of corresponding predetermined pluralities of the sub-areas of the viewing area.

24 Claims, 16 Drawing Figures

DIFFERENTIAL REFLECTIVITY METHOD AND APPARATUS FOR SORTING INDISCRIMINATELY MIXED ITEMS

BACKGROUND OF THE INVENTION

1. Field

The invention is in the field of apparatus and methods for automatically sorting mixed items and for removing those items which do not conform to predetermined standards. It is specifically concerned with the automatic sorting of items, such as pieces cut from peeled, raw, white potatoes in the production of commercially prepared food products, to eliminate defective items.

2. State of the Art

There are numerous machines described in the patent literature for sorting such items as fruits and vegetables. Many of these machines use light sources to illuminate the items to be sorted. In some cases the translucence of an item is a measure of its condition, defective items exhibiting different translucence than sound items. In such cases, light sensors are arranged to detect the light transmitted by the items being sorted. In other cases, the amount of light reflected from an item is a measure of its condition. In those cases, sensors are arranged to detect reflected light. In still other cases, the color of an item indicates its condition. In these other cases, reflected light of a certain wavelength is detected by light sensors, and associated filters are provided to pass to the sensors only reflected light of that wavelength.

A U.S. patent issued July 11, 1972, as U.S. Pat. No. 3,675,769, discloses a sorting system that detects ratios of reflected light of two wavelength ranges in order to differentiate between field-dug potatoes and rocks and dirt clods as the potatoes are being harvested. With this system, as with the color sorting systems mentioned which detect light within restricted wavelength ranges, the individual items to be sorted are segregated into longitudinal rows, down which they pass single file and are viewed individually as they pass.

SUMMARY OF THE INVENTION

In accordance with the present invention, the items to be sorted are passed through a viewing area and, subsequently, through a removal area as a continuous heterogeneous bed of indiscriminately mixed items substantially no thicker than the thickness of the individual items and having considerable width relative to the widths of the individual items. A conveyor, preferably of endless belt type, carries the bed through the viewing area, where it is flooded with radiant energy of two mutually different wavelengths, e.g. visible light energy and infrared energy, usually from light fixtures extending along the width of the viewing area and producing an integrated spread of the radiant energy throughout the viewing area.

The indiscriminately mixed items making up the bed reflect these energies of mutually different wavelengths in respectively different degrees, depending upon condition of the individual items. For example, potato cubes cut from peeled, raw, white potatoes reflect such energies according to a predetermined relationship if there are no dark spots attributable to defects of various kinds. If there are such dark spots, the energies will be reflected in other than the predetermined relationship.

The respective energies reflected from the bed passing through the viewing area are individually sensed by sensing devices of pairs of such sensing devices, e.g.

pairs of diodes of a dual diode array, scanning camera, focused on respective, contiguous, sub-areas of the viewing area extending across the width of the bed, and signals from the sensing devices of each pair are compared, e.g. by comparison circuitry of the scanning camera. Data signals, which result if the comparison of sensed signals show that the predetermined relationship between reflected energies exists for particular sub-areas of the viewing area, control the operation of potato removal devices in the removal area.

The potato removal devices, e.g. suction tubes, are arranged across the width of the removal area and have respective widths and correspond in location to predetermined pluralities of the sub-areas of the viewing area, so that any width portion of the bed passing through the removal area for which a predetermined number of data signals are produced will be removed.

The potato removal devices are individually operated by operating means, e.g. respective pneumatically actuated, power, piston and cylinder assemblies, controlled by data signal processing means, such as sophisticated electronic circuitry and data processing components.

THE DRAWINGS

The best mode presently contemplated for carrying out the invention is shown in the accompanying drawings, in which:

FIG. 1 is a pictorial view of the apparatus of the invention;

FIG. 2, a fragmentary, longitudinal, vertical section taken along the line 2—2 of FIG. 1 but with the utility unit removed from the downward extension of the housing immediately above and extending across the width of the conveyor belt;

FIG. 3, a transverse, vertical section taken along the line 3—3 of FIG. 1 and having an intermediate portion of the housing broken out;

FIG. 4, a view corresponding to that of FIG. 2, but taken along the line 4—4 of FIG. 3 and being more fragmentary longitudinally of the apparatus, there being shown in broken lines how the hinged wall of the downward extension of the housing swings outwardly;

FIG. 5, a fragmentary, transverse, vertical section taken along the line 5—5 of FIG. 3, showing the utility unit of the invention in place, the view being drawn to a larger scale, and maintenance positions of the lighting fixtures being indicated in broken lines;

FIG. 6, a similar section taken along the line 6—6 of FIG. 3;

FIG. 7, another similar section taken along the line 7—7 of FIG. 3;

FIG. 8, a fragmentary, longitudinal section taken along the line 8—8 of FIG. 5 and drawn to a larger scale to show details of the special lighting fixture;

FIG. 9, fragmentary horizontal section taken along the line 9—9 of FIG. 3 and drawn to a larger scale;

FIG. 10, a fragmentary vertical section taken along the line 10—10 of FIG. 9;

FIG. 11, a fragmentary vertical section taken along the line 11—11 of FIG. 1;

FIG. 12, a fragmentary vertical section taken along the line 12—12 of FIG. 1;

FIG. 13, an electrical circuit diagram applicable to the defect-determining portion of the apparatus;

FIG. 14, an electrical circuit diagram of the portion of the control circuitry that controls operation of the removal devices;

FIG. 15, an electrical circuit diagram of the portion of the control circuitry that monitors other portions of the control circuitry; and FIG. 16, an electrical circuit diagram of that portion of the control circuitry that functions as a safety interlock.

DETAILED DESCRIPTION OF THE ILLUSTRATED EMBODIMENT

In the particular form illustrated, the apparatus of the invention is adapted to sort cubes 10 cut from peeled, raw, white potatoes and having a size usually no greater than approximately ½ inch, removing defective pieces (those containing dark spots) from the sound pieces. The latter, 10*a*, are discharged to provide a potato product generally known in the industry as "Southern-Style Hash Browns."

Figure 1:
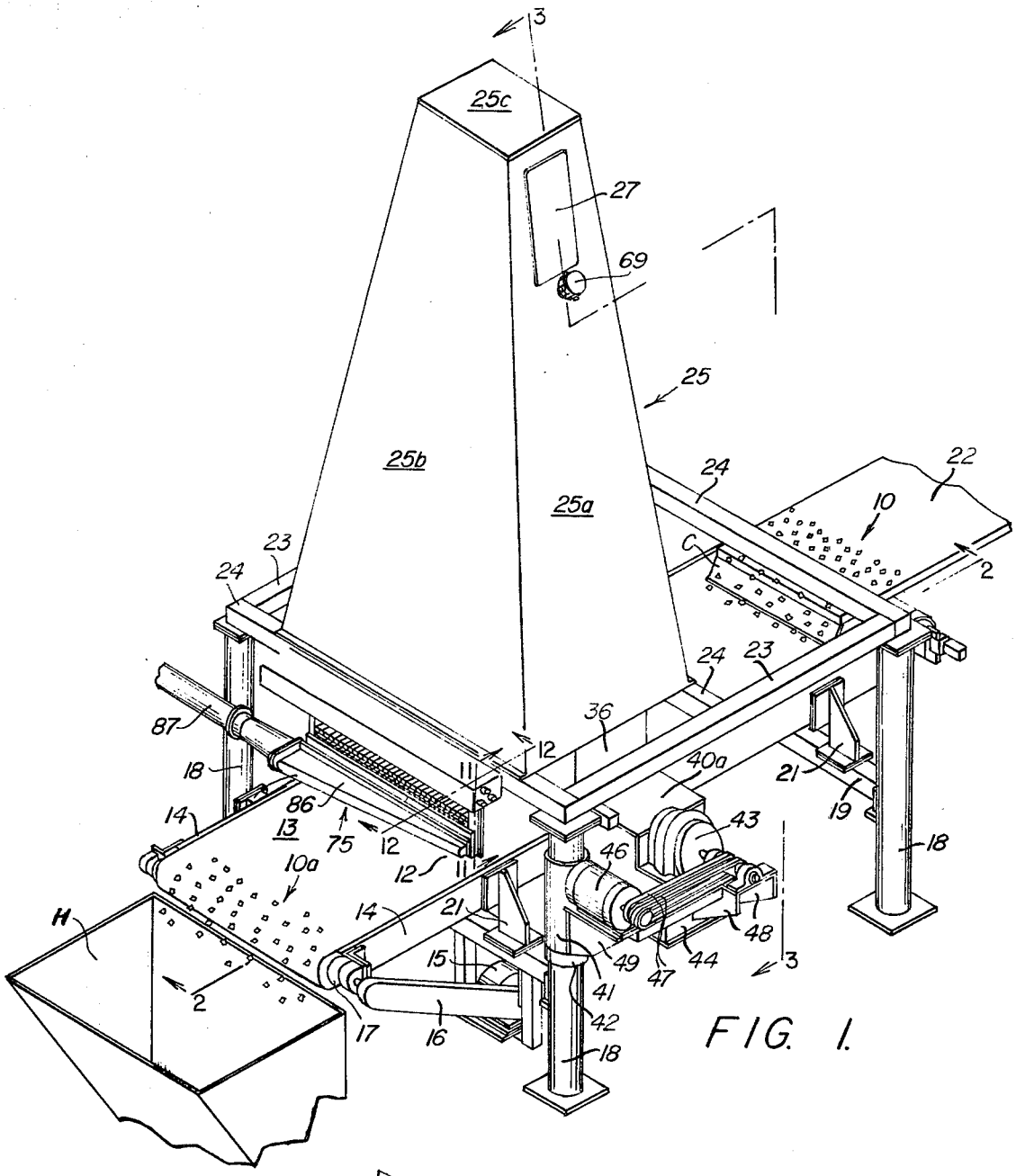
Figure 2:
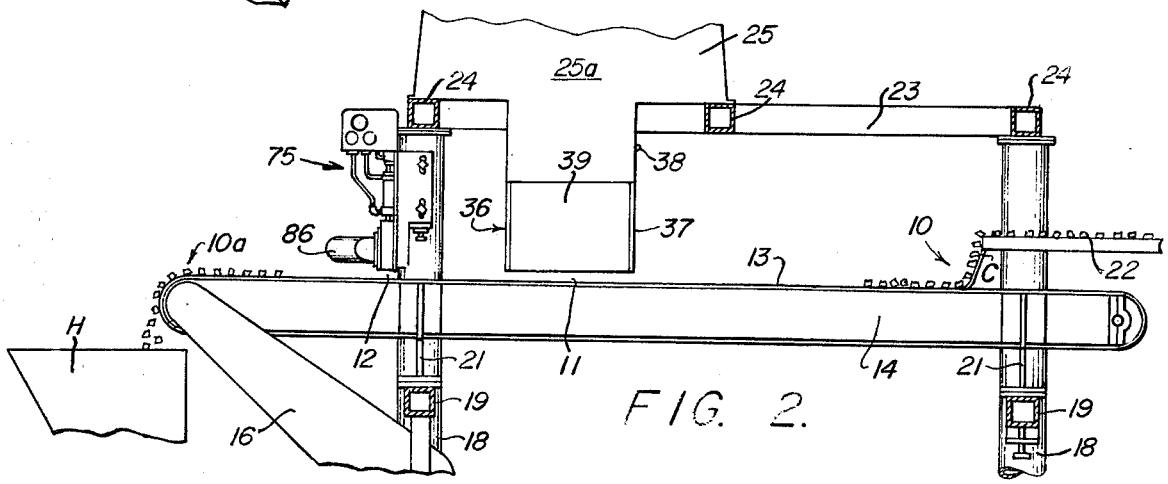

The indiscriminately mixed, defective and sound potato pieces 10 are passed through a viewing area 11, FIG. 2, and thereafter through a removal area 12, by means of a conveyor belt 13 on which the potato pieces ride. Belt 13 is preferably of seamless type used by food processors and is part of an endless conveyor having stationary side plates 14 extending longitudinally of the belt, which is driven in usual manner by an electric motor 15, FIGS. 1 and 3, through a belt drive 16 powering head roller 17.

The entire apparatus is mounted on and supported by legs 18. Crossbars 19, FIG. 3, mounted for height adjustment on adjustable brackets 20, extend between pairs of mutually opposite legs 18 and serve to support standards 21 which carry the side plates 14 of the conveyor.

The cut potato pieces 10 are fed in mass onto belt 13 by a standard shaker feeder 22, FIGS. 1 and 2. Cutting of raw whole potatoes following peeling thereof may be accomplished by conventional means (not shown), which discharge the cut potato pieces onto feeder 22. The vibration of feeder 22 distributes the potatoe pieces 10 fairly evenly over the width of the feeder and moves them toward the discharge end thereof, from where they fall by gravity onto a short chute plate C, for acceleration before finally dropping onto belt 13 intermediate edge margins thereof. The speed of belt 13 is maintained such that the potato pieces form a layer thereon approximately one potato piece deep.

In the apparatus shown, using a belt thirty-six inches wide, with only the center thirty-two inches carrying the product discharged from a shaker feeder thirty-two inches in width, satisfactory product distribution on the belt and effective operation of the entire apparatus is obtained at a belt speed of three hundred and fifty feet per minute. At such speed, the apparatus has a capacity of approximately twelve thousand pounds per hour. Slower belt speeds will have proportionately lower product-carrying capacity, while higher belt speeds will have proportionately higher product-carrying capacity.

Viewing area 11 and removal area 12 comprehend respective localized portions of the length of belt 13 over the entire width of the intermediate carrying portion thereof. While passing through viewing area 11, the potato pieces 10 are subjected to scanning by sensing means adapted to individually sense reflected energies of different wavelengths. A predetermined amount of time later, which depends upon the speed of travel of belt 13 and the distance between the two areas, defective potato pieces are removed from the mass of indiscriminately mixed potato pieces by removal means (FIGS. 11 and 12) while the potato pieces are passing through removal area 12.

The sound potato pieces 10*a* are discharged from the end of belt 13 into a hopper H, from which they pass to subsequent processing, such as weighing and packaging.

Viewing and Sensing Means

Viewing means are located above the viewing area, and include means for providing both visible light energy and infrared energy to the viewing area and sensing means for differentially detecting such visible light energy and infrared energy reflected from the viewing area.

Mounted on top of legs 18 is a frame comprising respective longitudinal members 23, extending parallel to belt 13, and respective crossbars 24 extending transversely of belt 13. An intermediate and an end crossbar 24 serve to support a housing superstructure 25 having respective, upwardly convergent, side walls 25*a*, end walls 25*b*, and a top wall 25*c*. Such walls are preferably panels of stainless steel welded at adjoining edges.

Figure 3:
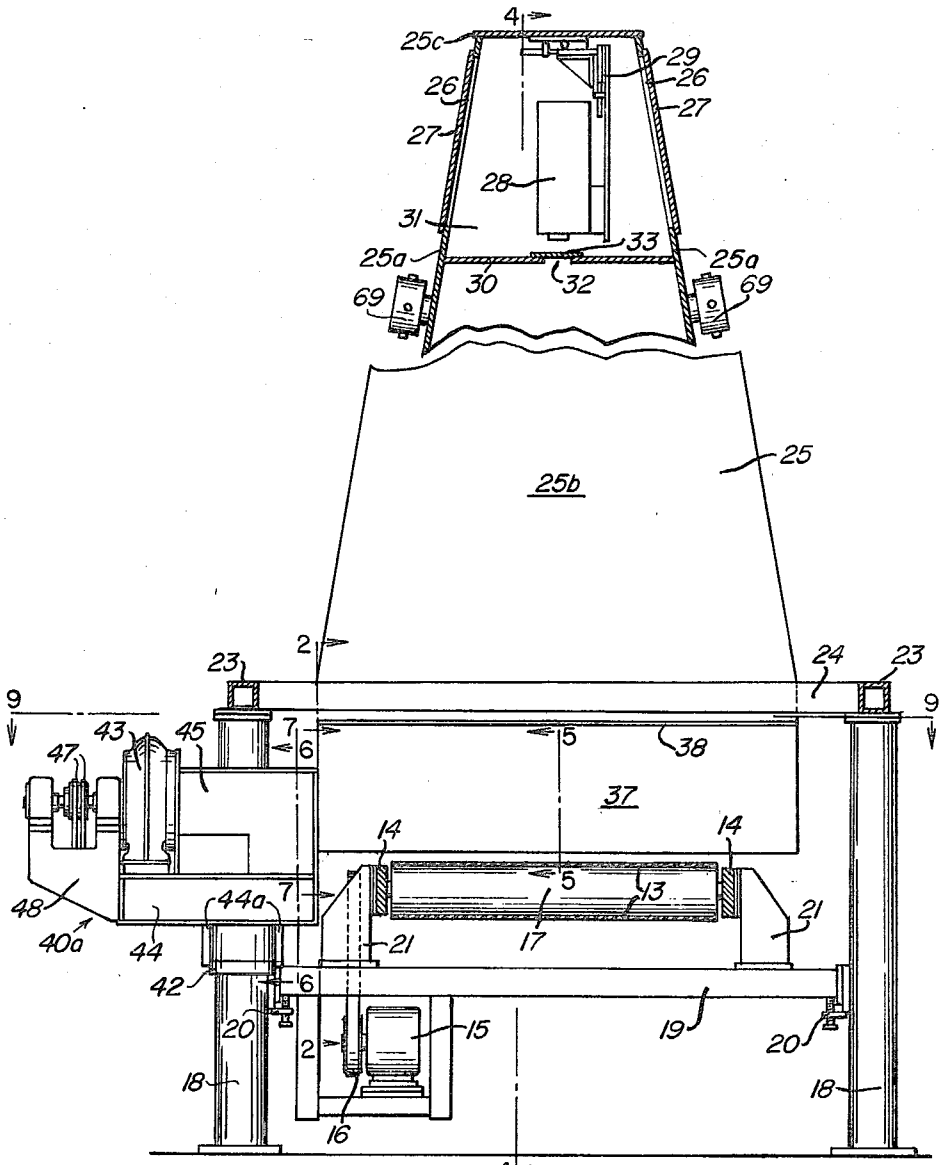

Mutually opposing side walls 25*a* are similarly apertured, as at 26, respectively, FIG. 3, to provide access to the interior of the housing, the apertures being normally closed by removable cover plates 27.

In the present embodiment, a scanning camera 28, such as the dual array, line scan camera designated LCD200 by its manufacturer Reticon Corporation, Mountain View, Calif., is used as the sensing means and also provides built-in, sensed-signal comparing means. It is adjustably mounted in the upper part of housing 25, and is desirably adjustable in all directions. To this end, in the illustrated embodiment, camera 28 is mounted on a Stoelting XYZ micrometer positioner 29, which is secured to the underside of housing top wall 25*c*. However, it should be understood that various other mountings can be used.

A partition wall 30 extends horizontally across housing 25 below camera 28 to provide a camera chamber 31. Partition wall 30 is apertured, as at 32, to provide a viewing opening covered by a pane 33 of transparent material, preferably plastic.

Figure 4:
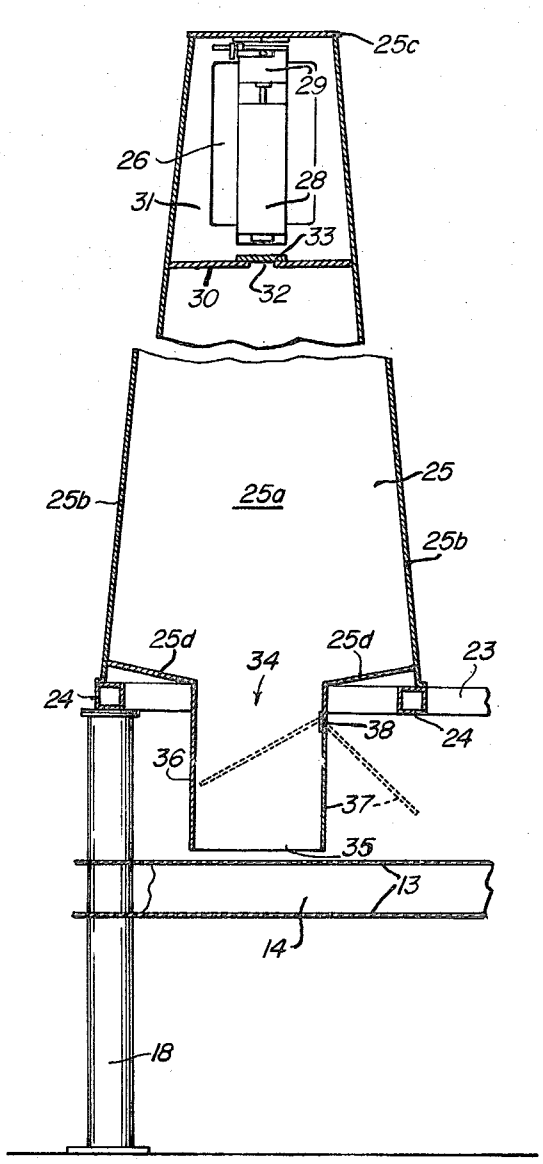

The bottom wall 25*d*, FIG. 4, of housing 25 has an opening 34 extending from one of the walls 25*a* transversely across belt 13 to the other wall 25*a*. Such opening 34 is extended downwardly to a lower opening 35 by a downward extension 36 of housing 25, which has one of its long walls 37 hinged, as at 38, to swing both outwardly and inwardly of the housing extension 36 and which is open at one end, see 39, FIG. 2, for the reception of a utility unit 40, FIGS. 5, 9, and 10, within the lower part of the space defined by such housing extension 36.

Utility unit 40 has a portion 40*a*, FIGS. 1, 3, 6, and 7, which projects from the open end 39 of housing extension 36 and is pivotally attached to a leg 18 of the apparatus by means of a sleeve 41, which rotatably encircles the leg and is supported thereon in any suitable manner, e.g., as shown, by a collar 42 secured to the leg. In this way, utility unit 40 is swingable away from its operational position within housing extension 36 and across belt 13 to a position alongside the belt, where the energy radiating, i.e. lighting, fixtures within the unit can be swung out as indicated by broken lines in FIG. 5, so as to be easily accessible for maintenance. Wall 37 of housing extension 36 swings outwardly for this purpose, then back and preferably inwardly, as indicated in FIG.

4, to close the bottom of the housing during periods of maintenance.

Figure 6:
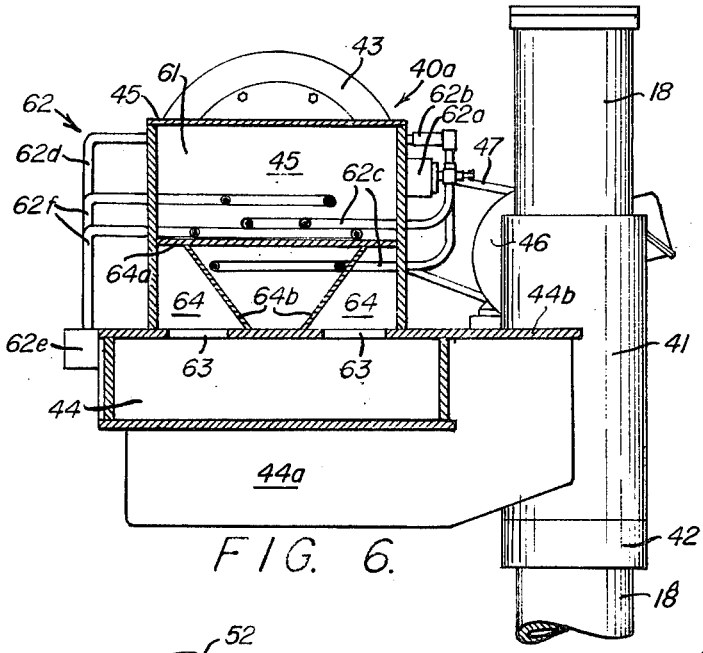

Portion 40*a* of utility unit 40 comprises a duct arrangement, see particularly FIGS. 3 and 6, for circulating cooling air in a closed circuit into and from the other portion of unit 40 that fits into downward extension 36 of housing 25. A blower 43 is supported by the protruding end of a lower duct 44, into which it forces cooling air. Hot air is returned to the blower by a duct 45. This duct arrangement is supported by brackets 44*a*, FIGS. 3 and 10, and by an extension 44*b*, FIGS. 6 and 9, of the upper wall of duct 44, which are secured to and extend in cantilever fashion from sleeve 41.

A motor 46, FIG. 1, runs blower 43 by means of a belt drive 47, which is supported at the blower by a bracket arrangement 48 secured to and projecting from the closed end of lower duct 44. The motor is mounted on a portion of duct wall extension 44 which is supported by a bracket 49.

Figure 5:
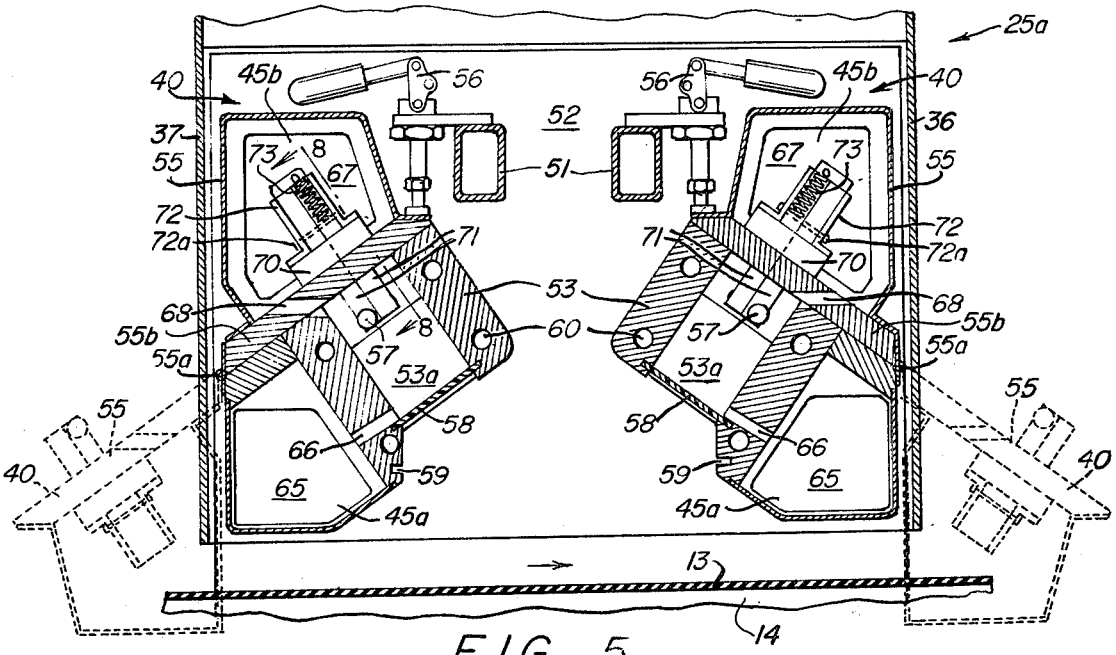
Figure 8:
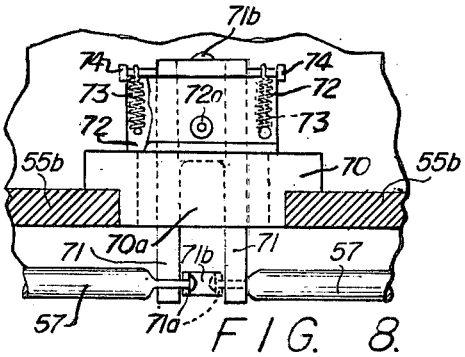
Figure 9:
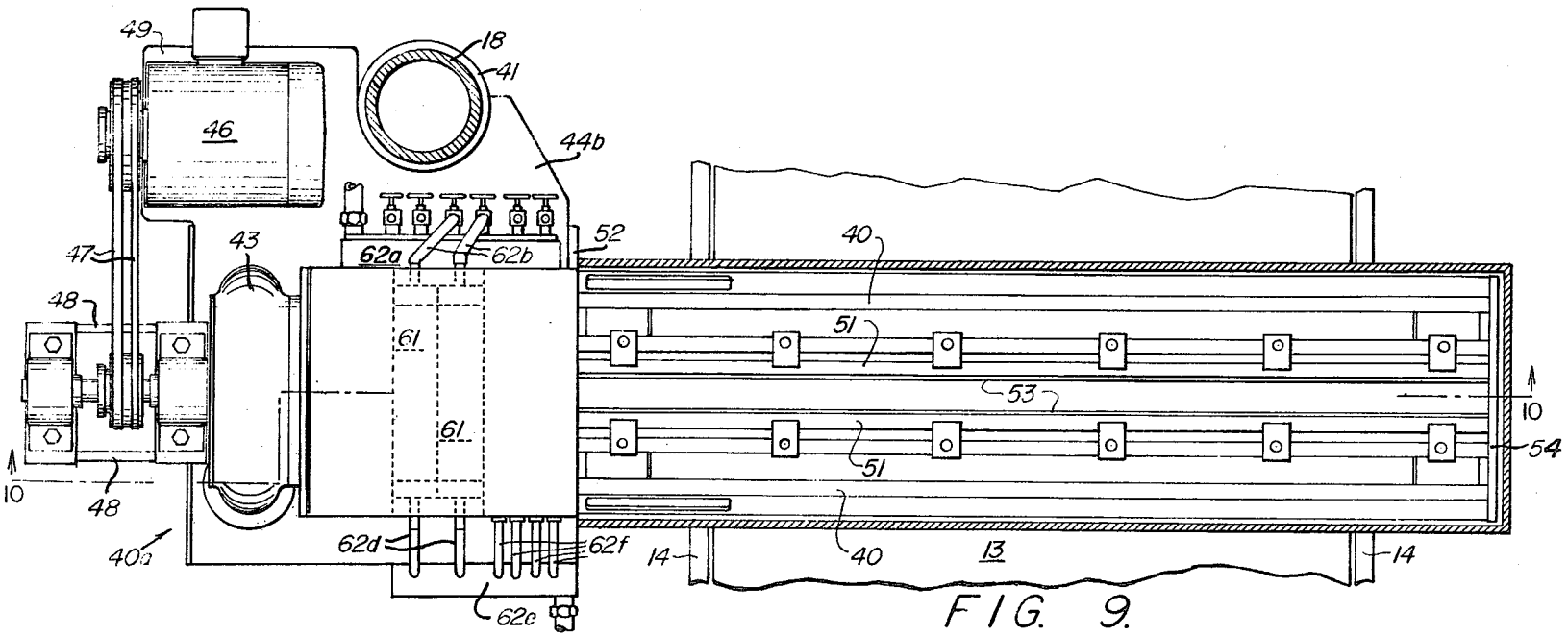
Figure 10:
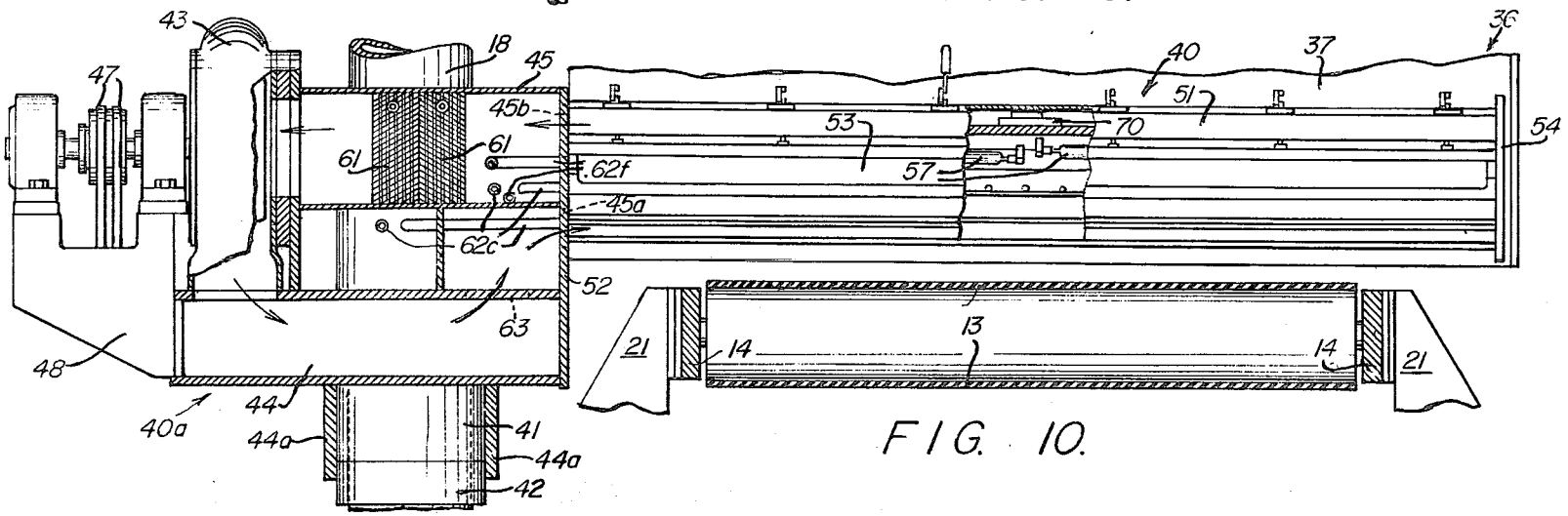

The portion of utility unit 40 that fits within downward extension 36 of housing 25 comprises structural members 51, FIGS. 5, 9, and 10 extending in cantilever fashion from a wall 52 of the duct arrangement that extends transversely of the utility unit, and further comprises elongate lamp-cooling boxes 53 extending similarly from wall 52. A plate 54 interconnects the otherwise free ends of members 51 and boxes 53 to provide structural rigidity. Such portion of utility unit 40 also includes swingable, radiant energy, i.e. light, fixtures 55 hinged at 55*a* but normally maintained in the positions shown in full lines tightly closing the open tops of boxes 53, by means of clamp 56. Operably fitted into electrical sockets of light fixtures 55 are electric lamps 57, which are preferably of quartz iodine type so as to produce a substantial output of both visible light energy and infrared energy. Eight lamps, each of 1500 watt rating, such as General Electric type Q1500T3/CL, have been found to produce satisfactory output for purposes of the invention. The lamps are staggered in position along the length of each fixture, as explained hereinafter with reference to FIG. 8, so as to provide substantially uniform illumination along the length of viewing area 11 toward which the visible light energy and the infrared energy from lamps 57 are directed in the normal working positions of fixtures 55. Clear plastic panes 58 are provided along the otherwise open bottoms of the respective lamp-cooling boxes 53 to guard against glass, from possible lamp breakage, falling into the potatoes moving through viewing area 11. Grooves 59, peripheral to the open bottom of utility unit 40, are advantageously provided for receiving and holding a protective panel across such open bottom during cleaning of the potato-handling portion of the apparatus.

For replacing lamps 57 and for other maintenance work, light fixtures 55 may be swung outwardly into accessible positions (indicated by broken lines in FIG. 5), when utility unit 40 is itself swung outwardly on its pivot axis (leg 18) as previously described. It should be realized that FIG. 5 shows the lighting unit in its working position within downward extension 36 of housing 25 and that the broken line positions of lighting fixtures 55 are assumed only after such lighting unit is swung to its maintenance position for servicing.

The electric lamps specified have a normal operating temperature of approximately 600° F. In the closed environment of utility unit 40, the temperature could easily exceed such operating temperature thereby damaging the lamps if cooling is not provided. Moreover, although a heat-resistant plastic, such as Rohm and Haas "Tuffak," is used for the protective panes, the temperature attained by such plastic should not exceed about 270° F. during operation over extended time periods. It is normal for the apparatus of the invention to operate over extended time periods. Accordingly, forced cooling is provided.

Figure 7:
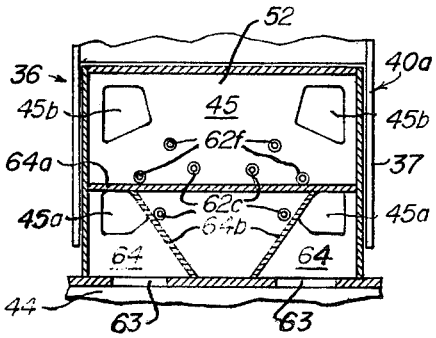

Cooling air is circulated through lamp-cooling boxes 53 and light fixtures 55 from blower 43 by way of duct 44, FIGS. 6 and 7, and a coolant, such as cold water at about 65° F., is circulated through passages 60 in the walls of light-cooling boxes 53 from any suitable source of same, e.g. the water supply system of the processing plant utilizing the apparatus. As shown, blower 43 pulls air from duct 45 and blows it into and through duct 44. Duct 45 contains a heat exchanger 61, see particularly FIGS. 9 and 10, which is conveniently formed by mounting two automobile heater cores side-by-side for circulation of a coolant, such as cold water, from a circulatory system 62 that also supplies coolant to the flow passages 60 of lamp-cooling boxes 53.

Circulatory system 62, FIG. 6, comprises a coolant input manifold 62*a*, see also FIG. 9, from which piping 62*b* supplies heat exchanger 61 and piping 62*c* supplies the flow passages 60 through the walls of lamp-cooling boxes 53. Exhaust coolant from heat exchanger 61 flows through piping 62*d* to an exhaust manifold 62*e*, and exhaust coolant from flow passages 60 flows through piping 62*f* to the same exhaust manifold 62*e*.

The cooled air forced by blower 43 into duct 44 flows through openings 63 into respective passages 64 that are defined in the lower part of duct 45 by a horizontal partition wall 64*a* and by divider walls 64*b*. Passages 64 connect, through openings 45*a*, FIGS. 5 and 7, in wall 52, with respective ducts 65, FIG. 5, which extend along the length of the portion of utility unit 40 that fits within downward extension 36 of housing 25 and from which the cool air flows through respective series of passages 66 across plastic panes 58 and into and along chambers 53*a* within lamp-cooling boxes 53. The cool air suffuses about lamps 57 and flows up into respective ducts 67, FIG. 5, in light fixtures 55 through respective series of passages 68 in such light fixtures. From ducts 67, the now heated air returns to duct 45 through corresponding openings 45*b*, FIG. 7, in wall 52, where it is recooled and recirculated.

Air vents 69, FIGS. 1 and 3, are preferably provided in the upper part of housing 25 below partition wall 30 to ventilate the interior of the housing.

Special Light Fixture

Although commercial light fixtures of various kinds could be used in the apparatus, it is preferred that they be specially constructed, as is the illustrated fixture 55, FIGS. 5 and 8, which includes special electrical sockets for the lamps 57.

Insulating ceramic blocks 70 are positioned to rest on, and extend through respective openings in, the lower wall 55*b* of each such light fixture 55. For each block 70, mutually offset bus bars 71 extend through a central opening 70*a* in the block and support respective, electrical, lamp-receiving sockets in similarly offset positions. Bus bars 71 are pivotally mounted in common on a pivot pin 72*a* which extends between mutually spaced structural angles 72 that are secured to and rise from the upper surface of insulator block 70.

Each bus bar 71 is resiliently biased by a coil spring 73 having one end attached to an arm 74, extending from the upper end of the corresponding bus bar 71 at the same side thereof which carries the socket 71*a*, and having the other end attached to the corresponding structural angle 72. Thus, the lower end of the bus bar and the socket 71*a* carried thereby are constantly urged toward the lamp 57 that is fitted into the socket and a good electrical connection is assured at all times. An electrical terminal 71*b* is provided on each bus bar for connection to a power supply.

As so constructed, the lamps 57 may be arranged very closely together with their ends overlapping, so that there is only a small break between the light producing portions thereof. This helps to provide an even spread of radiant energy through the viewing area. It is preferred to arrange the sockets and lamps in this way, at opposite sides of the center of utility unit 40. At the ends of the utility unit, however, there will be only one socket and the fixtures will be modified accordingly. At the center of the utility unit, it has been found satisfactory to not have the overlapping arrangement. Accordingly, the sockets 71*a*, arms 74, and springs 73 are positioned at respectively opposite sides of the bus bars.

In all arrangements, the sockets are wired so that electric current flows through the lamps from the socket at one end of the lamp to the socket at the other end thereof.

Removal Means and Operating Means Therefor

The removal means for those cut potato pieces 10 which contain dark spots indicative to defects comprise a series of removal devices and respective operating devices therefor, shown generally at 75, FIGS. 1 & 2. Such removal devices are arranged contiguously as a series extending transversely across belt 13 downstream from viewing area 11 and directly above removal area 12. They are mounted on height-adjustable brackets 76, which depend from one of the crossbars 24 at respectively opposite sides of the apparatus. Height adjustment is provided for by set screws 76*a* and by sets 76*b* securement bolts and slots.

Figure 12:
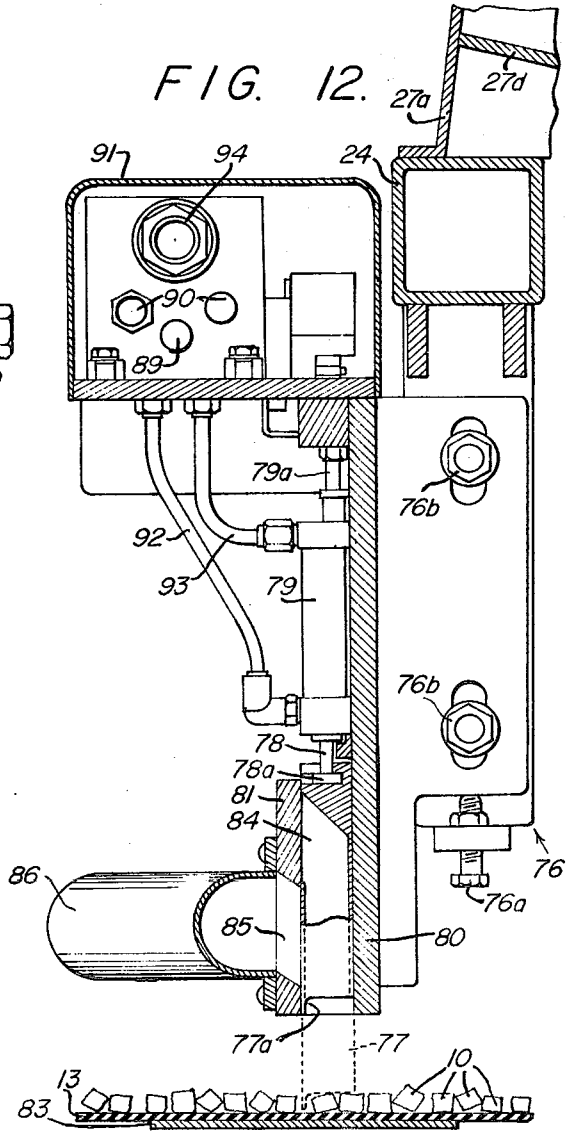
Figure 11:
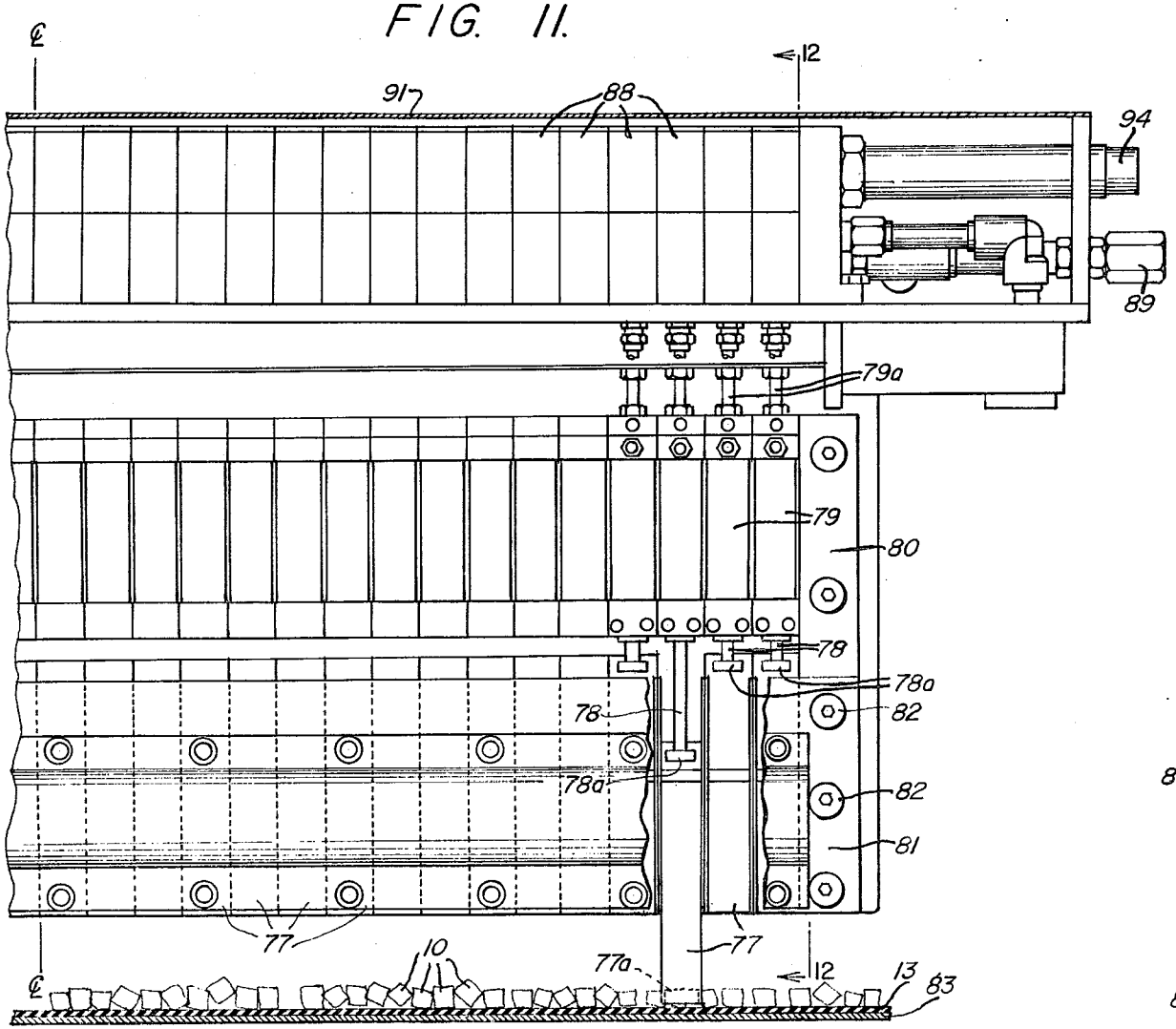

In the form illustrated, the removal devices are a partially hollow, potato-removal tubes 77, FIGS. 11 and 12, square in cross section and normally held above both belt 13 and the potato pieces 10 thereon by respective piston rods 78 of pneumatically operated cylinder and piston assemblies 79 constituting the operating means. The piston rods have headed lower ends 78*a*, which slide into corresponding receiving slots formed in the upper ends of the respective tubes 77, such upper ends being solid as shown. Thus, the tubes are separable from the pistons to facilitate assembly and disassembly.

As shown, the potato-removal tubes 77 are slidably mounted between back and front, preferably stainless steel, plates 80 and 81, respectively, for vertical movement under the control of cylinder and piston assemblies 79, respectively. Orientation, however, could be other than vertical, e.g. could slope so that the lower, open ends of tubes 77 face the on-coming potato pieces on belt 13 at an acute angle (e.g. about 25°). Plates 80 and 81 are secured together in properly spaced relationship by bolts 82 passing through marginal spacer strips laterally of the assembled tubes. Brackets 76 are secured, as by welding, to the back face of plate 80. The cylinder and piston assemblies 79 are attached to the upper part of back plate 80, which rises above front plate 81.

Tubes 77 are preferably made of an ultra-high molecular weight polyethylene plastic to provide durability with light weight and to be capable of sliding easily on the back and front plates between which they are positioned. The light weight is important, so as to minimize load and impact stress on the cylinder and piston assemblies during movement of the tubes, which is very rapid.

Tubes 77 and cylinder and piston assemblies 79 are arranged so that piston rods 78 are normally withdrawn into their cylinders. A rigid plate 83, preferably of steel, is positioned below belt 13 within removal area 12 to insure that the belt is always a constant distance from tubes 77 when such tubes are in their normal positions and to keep the belt substantially flat and in a constant position when one or more of such tubes are pushed downwardly to just short of pressing against the surface of belt 13 upon activation of their respective cylinder and piston assemblies. The lower ends of tubes 77 are hollow and open, with respective, downwardly projecting lips 77*a*, which may constitute for each tube a downward extension of one or more wall panels thereof. Consequently, the bottom and a portion of the sides of each tube are open to admit potato pieces when the tube is lowered into working position.

Potato pieces 10, within the width portion of the bed of same on belt 13 that is comprehended by a removal tube 77, are sucked into such tube when lowered into working position on or slightly above the belt. For this purpose, that wall panel of each tube 77 facing plate 81 is apertured, as at 84, for registry with an aperture 85, in front plate 81, that extends along the length of the plate transversely of belt 13 and opens into a vacuum manifold 86 secured over such aperture 85. Vacuum manifold 86 is connected by piping 87, FIG. 1, to any suitable source of vacuum and waste depository (not shown) for potato pieces 10 sucked from the carrying surface of belt 13. It has been found that a vacuum of about five inches of mercury, created by a blower having a capacity of 800 cubic feet per minute, is satisfactory and that the potato pieces removed from belt 13 will pass through the blower to a suitable waste receptacle at the exhaust side of the blower.

When tubes 77 are in their retracted positions, they block the entrance to vacuum manifold 86, sealing it closed so that nothing is sucked through the tubes.

As illustrated, vacuum manifold 86 is tapered so that it is larger where connected to the vacuum line and progressively smaller in its extension to the opposite end. Thus, the suction effect will be substantially uniform for all of the potato removal tubes 77.

Cylinder and piston assemblies 79 are preferably actuated pneumatically under the control of electrically controlled, pneumatic valves 88. Such valves 88 may be pilot-operated, spool type (manufactured by Mac Valves Incorporated under Model No. 811B-611D-142) designed to operate on 24 volts DC and ganged together with a common inlet 89 for pressure air and a common exhaust 90. As shown, they are protectively mounted in a housing 91.

A series of air supply lines 92 and 93 connect valves 88 with the cylinder and piston assemblies 79, respectively. Electrical wiring from the control circuitry extends through conduit 94 and connects with the respective valves.

General Arrangement and Operation Control

As previously indicated, in the illustrated embodiment the belt is thirty-six inches wide and the cut potato pieces 10 are deposited onto an intermediate thirty-two inches of the belt width. The field of view of camera 28 is adjusted to span the total width of the bed of deposited potato pieces as such bed passes through viewing area 11.

Each of the two, linear, diode arrays of the "Reticon", dual array, scanning camera contains one thousand and twenty-four light sensitive diodes. The diodes of one array are arranged to detect visible light energy in the range of wavelengths from 400 to 700 nanometers. The diodes in the other array are arranged to detect infrared energy in the range of wavelengths from 900 to 1100 nanometers. The two arrays are precisely set up, so that corresponding diodes of each array (diode pairs) are focused on exactly the same small portion of the viewing area and produce respective signals for comparison with each other to determine whether or not a predetermined relationship therebetween, indicative of a dark spot defect, exists. The diode pairs are arranged side-by-side, so as to focus on respective contiguous sub-areas of viewing area 11 extending serially across the width of belt 13. The particular camera utilized in this embodiment of apparatus has a seventy-five millimeter lens and is positioned so that the distance from the lens to the potato pieces in the viewing area is approximately ninety-four inches.

Camera 28 senses only those portions of the visible light energy and infrared energy from lamps 57 which are reflected to it from the viewing area. Potato pieces 10 that are sound and without defect reflect substantial amounts of both visible light energy and infrared energy and do so in a constant proportion. Belt 13 is made so as to reflect the visible light energy and infrared energy in the same proportion. Accordingly, the camera does not distinguish between the energy reflected from sound potato pieces and the energy reflected from the belt. However, visible light energy and infrared energy are reflected in much different proportion by dark defective spots in the cut potato pieces than by the white, sound potato flesh. Generally speaking a defect will reflect much less visible light energy than it does infrared energy and much less visible light energy than does a sound potato piece. Thus, if the amount of reflected visible light energy is at least a predetermined amount less than the reflected infrared energy, a defective potato piece is indicated.

In the particular embodiment concerned, each diode will observe a linear distance of 1/32 of an inch. Thirty-two of the diodes will observe an inch of belt width. Potato removal tubes 77 are each one inch in width. Since the positions of potato pieces 10 on the belt as it passes through removal area 12 are the same as when the belt passes through viewing area 11, each of the removal tubes will be controlled by a corresponding plurality (thirty-two) of diode pairs viewing a corresponding plurality (thirty-two) of sub-areas of the viewing area and will remove a corresponding one inch portion of the width of the potato bed that passes through the removal area a predetermined time, depending upon conveyor belt speed, after the reflected energy from that portion of the bed is sensed and indicates that such portion should be removed.

The "Reticon" camera preferred for use in connection with this invention includes electronic components and circuitry for comparing signals produced by each diode pair and for producing a resultant data signal when the comparison shows a predetermined relationship indicative of a defect in the viewed potato piece. The control circuitry forming a part of the present invention may be arranged to activate any of the removal tube operating devices upon receiving a predetermined number, one or more, of data signals for that removal tube.

Control Circuitry

In describing the embodiment of control circuitry here illustrated by FIGS. 13–16, the term "high" indicates a positive voltage signal or a logic level 1, and the term "low" indicates a zero voltage signal or a logic level 0. "Goes high" or "positive-going pulse" indicates that a signal changes from logic level 0 to logic level 1, which is a positive change, and "goes low" or "negative-going pulse" indicates that a signal changes from logic level 1 to 0, which is a negative change. When a component is specifically identified in relation to brand name and number, all similar components mentioned may be that same brand and number unless otherwise specified.

As previously indicated, the camera contains internal circuitry, which, starting at the number one diodes of the two arrays, sequentially compares the reflected energy sensed by the corresponding diodes of the two arrays. For example, the number one diodes of the two arrays form a pair of diodes for comparison purposes, one with the other, as do the number two diodes of each array, etc. Comparisons of the respective signals from diode pairs are controlled by a clock signal, which advances the pair of diodes being compared with each pulse of the clock signal. Several pulses of the clock signal occur between the end of one scan and the beginning of the next. The presently preferred clock rate to provide satisfactory resolution is such that the camera completes twelve scans (compares the output of each of the 1024 pairs of diodes twelve times) for each inch of belt travel. At a belt speed of 310 feet per minute, 745 scans per second are required. The faster the clock rate, the more reflected energy is necessary. Therefore, the clock rate and thus the belt speed are limited by the amount of radiant energy that can be supplied to the viewing area.

Figure 13:
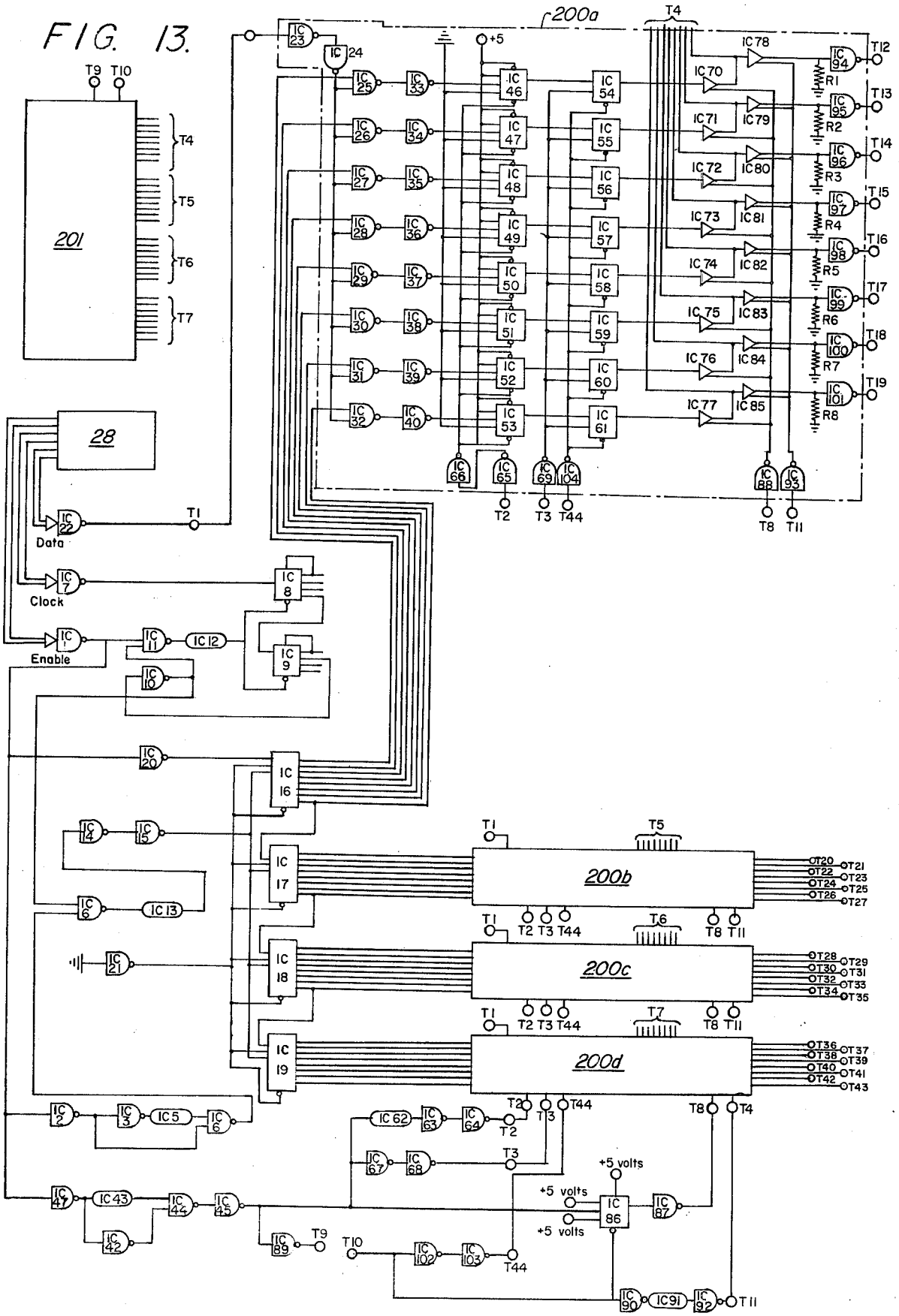

Camera 28, FIG. 13, produces three output signals, namely, the clock signal which is a series of pulses that controls advance of the camera scan through the diode arrays and the period of time between scans, an enable signal which indicates when a scan is taking place, and a data signal which indicates whether or not the output of the diode sensing the visible light energy is a predetermined amount less than the output of the diode sensing the infrared energy for the particular pair of diodes being compared. Each of these output signals from the camera is actually a pair of signals. One signal of the pair is the opposite of the other signal of the pair. Thus, one of the enable signal pair would be high during each scan and low between scans, while the other signal of that pair would be low during each scan and high between scans.

The enable signal pair is connected to a differential line receiver, such as a Fairchild 9620, indicated as IC1, which is connected to produce a high output during the time the camera is scanning the diode arrays.

The output of IC1 is sent to a trailing edge detector made up of inverters IC2, IC3, IC4, and delay line IC5. The inverters may be Signetics N7404's, the NAND gate a Signetics N7400, and the delay line a Bel 446. The signal from IC1 is inverted by IC2 and IC3 and is delayed by IC5. The signals from IC5 and IC2 are inputs to NAND gate IC4, which produces an output that is a negative-going pulse of duration equal to the delay of delay line IC5 and beginning at the end of the enable signal from IC1.

The output of IC4 is an input to NAND gate IC6.

The clock signals from the camera are connected to differential line receiver IC7, so that each clock pulse from the camera produces a positive-going pulse from IC7. The output of IC7 is an input to binary counter IC8, which is connected in series with binary counter IC9. The binary counters may be Signetcis N7493's. IC8 and IC9, together, will count thirty-two clock pulses, at which time IC9 produces a positive pulse that is sent to inverter IC10. IC10 inverts the signal from IC9. The output of IC10, which goes low after thirty-two clock pulses are counted, is an input to IC6 and an input to IC11. The second input to NAND gate IC11 is the output of IC1, which is high during the enable signal. The output of IC11, which is high between enable pulses, goes low during the enable pulse, except when thirty-two clock pulses have been counted, as indicated by the output of IC10 going low. The low output of IC10 causes the output of IC11 to go high. The output of IC11 is delayed by delay line IC12. The high output of IC12 is connected to reset counters IC8 and IC9. Thus, the counters are reset between enable signals and after counting each set of thirty-two clock pulses during the camera scan.

At the end of an enable signal, the counters IC8 and IC9 are reset so that the output of inverter IC10 is high. Thus, the input of IC6 from IC10 is high. The input of IC6 from the output of IC4 is normally high. The trailing edge or end of the enable pulse causes the output of IC4 to go low, as explained above, causing one input of IC6 to go low. This causes the output of IC6 to go high. The output of IC6 is delayed by delay line IC13. The high output of IC13 is connected through inverters IC14 and IC15, which act as buffers and drivers between IC13 and shift registers IC16, IC17, IC18, and IC19. The shift registers may be Signetics 74164's. The output of IC15 is the same as, but delayed from, the output of IC6 and is sent to the clock or strobe inputs of shift registers IC16, IC17, IC18, and IC19. A high clock or strobe input to the shift registers causes the information in the registers to be moved forward one position.

At the end of the enable pulse, as explained, the output of IC1 goes low. The output of IC1 is an input to inverter IC20, which inverts the low input to a high output. This output is high and remains high only between the enable pulses. The output of IC20 is an input to the information input of shift register IC16, and, if the shift register is strobed while the input is high, a high level or logic one is set in the first position of the register. A one is set into the first position of shift register IC16 at the time the registers are strobed by the delayed end of the enable pulse, which delayed end occurs between enable pulses.

During the enable pulse, the input to IC6 from the output of IC4 is high. The input to IC6 from the output of IC10 is high, but goes low each time thirty-two clock pulses are counted. The thrity-two clock pulses counted correspond to the camera looking at thirty-two consecutive pairs of diodes in its dual diode arrays. When the output of IC10 goes low, the output of IC6 goes high causing the strobing of shift registers IC16, IC17, IC18 and IC19. The logic level one that was strobed into the registers between the enable pulses is shifted one position each time thirty-two clock pulses are counted during an enable pulse. No additional ones are strobed into the shift registers during an enable pulse because the output of IC20 is low during the enable pulse.

Inverter IC21 has its input grounded so that the output is always high. This high output is used as an input for each of the shift registers because the strobe input of the shift registers is arranged as a dual NAND gate with two inputs and in order for it to function in response to the change in output signal from IC6, the input connected to IC21 must be held high.

The pair of data signals from the camera is sent to a differential line receiver IC22, which is connected to produce a high output during the time the camera indicates that a comparison of any particular pair of diodes shows that the sensed visible light energy is at least a predetermined amount less than the sensed infrared energy. Such high output indicates that a defective potato piece has been sensed by the diodes.

The output of IC22 is sent to a total of thirty-two NAND gates, each gate corresponding to one of the thirty-two potato removal tubes 77 of the removal means 75. A single gate, such as the differential line receiver IC22, cannot reliably provide an input to thirty-two additional gates, so the circuitry is conveniently broken down into four groups of eight gates each. The circuitry of one of the four groups is shown in detail in the box labeled 200*a*. The boxes labeled 200*b*, 200*c*, and 200*d* are identical to 200*a*. It should be realized that the number of NAND gates and circuits therefor can vary and will depend upon the number of tubes 77 provided for the removal means.

The output of IC22 is interconnected through terminal T1 to boxes 200*a*, 200 *b*, 200*c* and 200*d*. The terminal designations do not necessarily represent actual terminal connections in the circuitry described, but are used in the description to indicate interconnections between various parts of the circuitry.

The output of IC22 is high when a particular pair of diodes being compared indicates that a defect has been sensed. The output of IC22 is sent to inverters IC23 and IC24, which are provided to supply the data signal to NAND gates IC25 through IC32. In this way, IC22 provides an input to a number of gates equal to the number of circuits provided, here four, and inverter IC24 or its corresponding inverter in each of the other circuits provides inputs to eight NAND gates.

As hereinbefore explained, counters IC16 through IC19 are connected in series so as to count to thirty-two. The first output of IC16, which is high at the beginning of a scan and before thirty-two diode pairs have been compared by the camera, is connected to an input of NAND gate IC25. The second output of IC16, which is high after the first thirty-two diode pairs have been compared and before sixty-four diode pairs have been compared, is connected to an input of NAND gate IC26. These connections continue in serial fashion through IC16, IC17, IC18, and IC19, as shown in the drawing, so that the last output of IC19, which is high during comparison of the last thirty-two diode pairs in the camera, is connected to the last NAND gate in box 200*d*.

With the arrangement described, all data information is sent to all NAND gates IC25 through IC32. The data signal will only be transmitted through a NAND gate if there is also an input from one of the shift registers IC16, IC17, IC18, or IC19. Thus, during comparison of the first thirty-two diode pairs, the first output of IC16 will be high, while the remaining outputs of IC16, IC17, IC18, and IC19 will remain low. If a comparison of at least one pair of the first thirty-two diode pairs causes a high output of IC22 and, in turn, a high output of IC24, IC25 will go low. Similarly, if a comparison of any of the pairs of diodes in the second set of thirty-two diode pairs causes a high signal from IC22, the output of NAND gate IC26 will go low since both inputs will be high. The remaining corresponding NAND gates will operate similarly, with only one of the NAND gates having a high input from IC16, IC17, IC18, or IC19 at any one time. The outputs of NAND gates IC25 through IC32 are inverted by inverters IC33 through IC40, respectively. A high output from inverters IC33 through IC40 indicates a defect has been sensed. The particular inverter indicates in which group of thirty-two diode pair groups corresponding to the thirty-two tubes 77 of the removal means 75 the defect has occurred.

A leading edge detector for the enable signal from IC1 is formed by inverters IC41 and IC42, delay line IC43, and NAND gate IC44. The signal from IC1 is inverted by IC41, is delayed by delay line IC43, and is sent to NAND gate IC44. The other input of IC44 is the signal from IC41 as inverted by IC42. IC44 produces a negative-going pulse of duration equal to the delay of delay line IC43 at the beginning of an enable signal. A signal from IC44 is inverted by inverter IC45.

The outputs of inverters IC33 through IC40 are connected to the strobe or clock inputs of J-K flip flops IC46 through IC53 which may be Signetics 74109's. The outputs of flip flops IC46 through IC53 are connected to the inputs of flip flops IC54 through IC61 which may be Signetics 74174's.

The J-K flip flops IC46 through IC53 are set with their J input held at a positive five volts and their K inputs held at 0 volts or ground. The positive pulse at the beginning of the enable signal, which is the output of IC45, is delayed by delay line IC62 and is sent through inverters IC63 and IC64 to inverters IC65 and IC66 through interconnection of terminals T2. Inverters IC63 and IC64 serve to buffer the delay line IC62. The signal from inverter IC66 is sent to the reset terminals of the eight flip flops IC46 through IC53. Thus, the flip flops IC46 through IC53 are reset by the delayed leading edge signal from IC45 so that their outputs are low. Delay time is determined by delay line IC62.

If a pair of diodes in the camera senses a defect, a positive output will appear from one of the inverters IC33 through IC53 or corresponding inverters in boxes 200*b*, 200*c*, or 200*d*, as explained above. With flip flops IC46 through IC53 in reset condition, the end of the positive defect signal from any of the inverters will be a negative-going pulse and cause the appropriate flip flop to set, causing a high to appear on its output.

The outputs of flip flops IC46 through IC53 are connected, respectively, to the set inputs of flip flops IC54 through IC61. The clock or strobe inputs of flip flops IC54 through IC61 are connected through inverters IC67, IC68 and IC69 from IC45. This causes a negative pulse to be applied to the flip flop at the beginning of the enable signal. Thus, at the beginning of the enable signal, flip flops IC54 through IC61 are strobed and take either the set or reset condition that the flip flop, connected to its input, is in. Thus, if flip flop IC46 has a high output, IC54's output will go high. If the output of IC46 is low, IC54 will take that same condition and its output will be low. The outputs of IC54 through IC61 will take the same outputs as flip flops IC46 through IC53.

After the outputs of IC46 through IC53 have been set into flip flops IC54 through IC61 by the leading edge of the enable pulse (this could also be done by the trailing edge of the enable pulse if connected to IC4), the flip flops IC46 through IC53 are reset by the delayed leading edge of the enable pulse, as explained, and are ready to accept defect information from the inverters IC33 through IC40.

A microprocessor 201, such as a Motorola 6800, is used to store the data from the shift registers IC54 through IC61 and to later send the stored data as output to operate one or more appropriate potato removal tubes 77.

In order to interface the flip flops IC54 through IC61 with the microprocessor, logic commonly known as "tri-state logic" is established using bus buffer gates such as Signetics 74126's. The bus buffer gates are identified as IC70 through IC85, and are arranged in twos, as shown. Sets of terminals T4 through T7, each containing eight individual connections, are interconnected to the input-output portion of the microprocessor. Each of these terminals may be either an input to or an output from the microprocessor at any time, depending upon how it is programmed.

In the present circuitry, the microprocessor is programmed to accept and store information from the flip flops. The microprocessor accepts and stores the information in memory locations having eight bit capacities. Thus, it accepts and stores information from eight of the flip flops at a time. It first accepts and stores the information from flip flops IC54 through IC61 and then moves on and accepts and stores information from the eight corresponding flip flops in box 200*b*, then 200*c*, and then 200*d*. The memory is arranged as a revolving memory, with a fixed number of memory locations. The number of memory locations determines the lag time between information entering the memory and later being read out. The normal sequence is to read information into four consecutive memory locations, read information out from the next four consecutive memory locations, read information into those four locations that have been read out, and move on to the next consecutive four memory locations for read-out and then read-in, and so forth. Presently, the desired delay time is achieved using 760 memory locations.

The enable leading edge signal from IC45 is connected to flip flop IC86. The leading edge pulse from IC45 sets flip flop IC86, giving a high output to inverter IC87. The output of IC87 is sent to the input of inverter IC88 via interconnection of terminals T8. The output of IC86 will remain high, causing a high output from IC88 until IC86 is reset. The high output from IC88 is sent to bus buffer gates IC70 through IC77. The output of flip flops IC54 through IC61 are connected to respective bus buffer gates IC70 through IC77. With high output from IC88, buffer gates IC70 through IC77 have very low impedance and in effect connect the outputs of flip flops IC54 through IC61 directly to terminals T4.

The leading edge signal from IC45 is inverted by IC89 and connected to terminal T9. Terminal T9 is connected directly to microprocessor 201, so that a signal at T9 starts the program in the microprocessor. Upon starting the program, terminals T4 through T7 become inputs to the microprocessor and the information from the flip flops of boxes 200*a*, 200*b*, 200*c*, and 200*d* are read into four consecutive memory locations of the microprocessor. Upon reading the information on terminals T4 through T7 into the microprocessor, the microprocessor produces a signal at terminal T10.

The signal from T10 is inverted by inverter IC90, delayed by delay line IC91, and inverted again by inverter IC92. It is then sent to inverter IC93 via interconnection of terminals T11. The output of inverter IC93 is connected to bus buffers IC78 through IC85. With a high signal at T10, which is produced by the microprocessor after it has completed reading into memory the information on terminals T4 through T7, flip flop IC86 is reset, causing the output of IC88 to go low and the impedance of bus buffers IC70 through IC77 to go high and essentially be an open circuit. The output of IC93 goes high, causing the impedance of bus buffers IC78 through IC85 to be very low, so that terminals T4 through T7 are connected to inverters IC94 through IC101.

With the signal at terminal T10 high, the microprocessor terminals T4 through T7 become output terminals and the information from the four consecutive memory locations after those into which the information had just been read, are connected to inverters IC94 through IC101. Resistors R1 through R8, connected between the input of inverters IC94 through IC101, respectively, and ground, are to insure that during periods of high impedance of bus buffers IC78 through IC85 (no current flow from IC78 through IC85), the input to inverters IC94 through IC101 are maintained at 0 level. The outputs of the inverters for each box appear at terminals T12 through T43.

The signal from the microprocessor at terminal T10 passes through inverters IC102 and IC103 and is sent to inverter IC104 through interconnection of terminals T44. A positive signal at terminal T10 from the microprocessor indicates that the information on flip flops IC54 through IC61 has been read into the microprocessor memory. This positive signal becomes a negative signal from inverter IC104 and is sent to the reset terminals of flip flops IC54 through IC61 and resets them so that they are ready to accept information from flip flops IC46 through IC53.

After the information is read out of the microprocessor, the microprocessor waits until it receives a signal from T9, indicating that a new scan has begun, before continuing.

A brief review of the operation of the circuitry to this point will be helpful. It should be remembered that the dual diode arrays of the camera each contain 1024 diodes and that removal means 75 contains thirty-two potato removal tubes 77. Thus, there is a set of thirty-two diodes corresponding of each tube 77. The first thirty-two diodes of the two diode arrays will sense reflected visual and infrared energy from a portion of the bed which will later pass under the first removal tube. The second thirty-two diodes will do the same for the adjoining portion of the bed which will later pass under the second removal tube, and so on through the entire set of thirty-two removal tubes. The camera compares each pair of diodes in each of the dual diode arrays consecutively, and advances the pair compared with each clock pulse during a scan.

The circuitry discussed so far is arranged so that a high signal is placed in the first position of a thirty-two position shift register prior to or at the beginning of a scan. With each thirty-two clock pulses from the camera, the one is moved one position through the shift register. The data signal from the camera indicating whether or not a defect has been sensed by a particular pair of diodes is ANDed with the signals from the shift register in a series of thirty-two NAND gates. Each of the thirty-two NAND gates correspond to one of the thirty-two removal tubes. This defect information is stored in a set of flip flops during the scan and at the beginning of the next scan is transferred into a second set of flip flops, from which it is transferred to the microprocessor during that scan. The second set of flip flops is then reset so that it is ready to accept the information from the first set of flip flops at the beginning of the next scan.

At the beginning of a scan the microprocessor reads into four consecutive memory locations the information from the second set of flip flops. After reading in the information, the microprocessor reads out the information which it has stored in the next four consecutive memory locations. After reading out this information, it waits until the beginning of the next scan and then reads (into the four memory locations it has just read out) the information then contained in the second set of flip flops. It then reads out the information contained in the next four consecutive memory locations. After going through all memory locations in that manner, it begins again at the first location.

The defect information read into the microprocessor is delayed by the amount of time occurring between reading of the information into the memory and reading of that same information out of the memory. The delay time is determined by the number of memory locations which are available in consecutive order for storage of the information. The delay time is set so that the defective potato pieces sensed in the viewing area 11 of the apparatus have moved to the defect removal area 12 of the apparatus when one or more of the removal tubes 77 are operated to remove a portion or portions of the bed of potato pieces.

Figure 14:
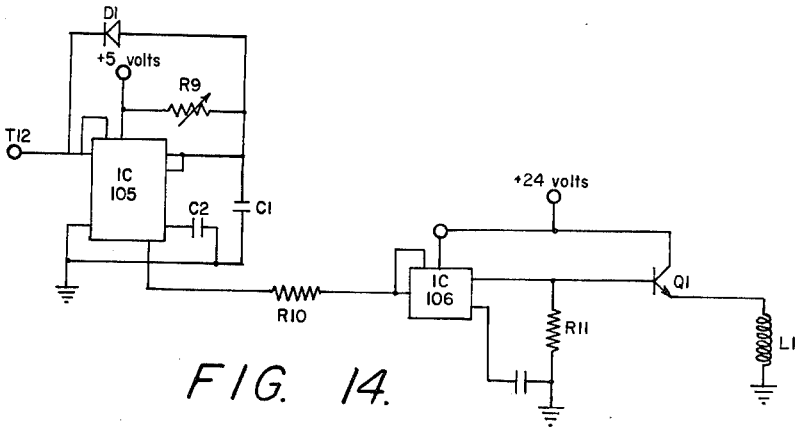

Returning now to the details of the circuitry, FIG. 14 shows the circuitry for operating the removal tubes. Thirty-two circuits identical to that shown are provided, each connected to one of the terminals T12 through T43 at the terminal indicated as T12 in FIG. 14. The signal from the inverter, such as inverter IC94, interconnected to the circuitry of FIG. 14 through terminal T12, will be high unless a defect has been sensed and that defect information has been read out of the microprocessor memory.

The signal from IC94 is sent to timer IC105, which may be a Signetics 555. The timer is connected so that, at the end of a negative pulse at the input connected to terminal T12, such negative pulse indicating a defect, it will produce a positive output pulse of a predetermined length. The length of the pulse is determined by the values of capacitors C1 and C2 and resistor R9. The length of the pulse is set to be compatible with the solenoid valves used to control the pressurized air which activates the operating devices for the respective potato removal tubes 77. Diode D1 insures proper resetting of the timer at the end of its timed pulse. The output of timer IC105 is connected through current limiting resistor R10 to optical isolator IC106. The optical isolator may be a Monsanto T2. A positive input to optical isolator IC106 connects the 24 volt source to resistor R11 for as long as the input continues. This produces a voltage across R11, which is applied to the base of transistor Q1. The transistor may be an Archer 2009.

Rather than using timer IC102 and associated circuitry to produce a pulse to operate the solenoid, the microprocessor could be programmed to produce the desired pulse directly.

With voltage on the base of transistor Q1, such transistor conducts, thereby causing the 24 volt supply connected to the collector of Q1 to appear across solenoid windings L1, which operates one of the solenoid valves 88 of the removal means. During the time the solenoid winding L1 is energized, solenoid valve 88 provides air to its corresponding piston and cylinder assembly 79, causing the attached removal tube 77 to be extended. If no defect is sensed, the output of inverter IC94 will remain high and no output from timer IC105 or isolator IC106 will occur. The solenoid winding L1 will not be energized, and potato removal tube 77 will remain in its retracted position.

The length of the timed pulse from timer IC105 is set so that it is slightly longer than the time required for a single scan and one complete cycle of the circuitry described. Thus, if a defect signal initiates operation of the timer, the timed output pulse will continue just beyond the time the next information is supplied to the timer. In this way, if the next information also indicates a defect, the timer is reset without a break in the output pulse, thereby keeping the potato removal tube 77 in down position. This prevents many rapid up and down movements of the removal tubes and lessens wear and tear. The length of the timer pulse for the embodiment illustrated is approximately thirty milliseconds.

Figure 15:
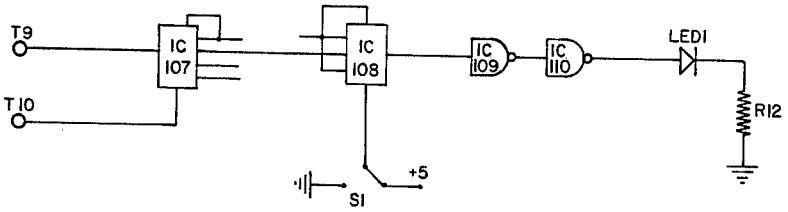

The circuitry shown in FIG. 15 is provided to give an indication when portions of the previously described circuitry are not operating properly. The leading edge signal from terminal T9 is sent to counter IC107. The signal from the microprocessor at terminal T10 is connected to reset the counter IC107. If counter IC107 counts two consecutive leading edge enable pulses it produces an output that is sent to flip flop IC108. Upon a signal from counter IC107, flip flop IC108 sets, sending a high signal to inverters IC109 and IC110 which causes light emitting diode LED1 to light. LED1 is located on the front panel of the control electronics or in another location where it can be observed. Resistor R12 is a current limiting resistor. The flip flop IC108 is manually reset by switch S1.

If the circuitry is operating properly, a leading edge enable signal will be produced at terminal T9 and sent to counter IC107. Next, a signal from the microprocessor will appear on terminal T10, indicating that the microprocessor has accepted and read into memory the information appearing on terminals T4 through T7. The signal on T10 resets counter IC107, and the counter does not reach the count of two. If for some reason the microprocessor does not accept the data on terminals T4 through T7, it will not produce a signal on terminal T10 before a second leading edge enable pulse appears on terminal T9. In this case, counter IC107 will count to two and LED1 will be illuminated.

Figure 16:
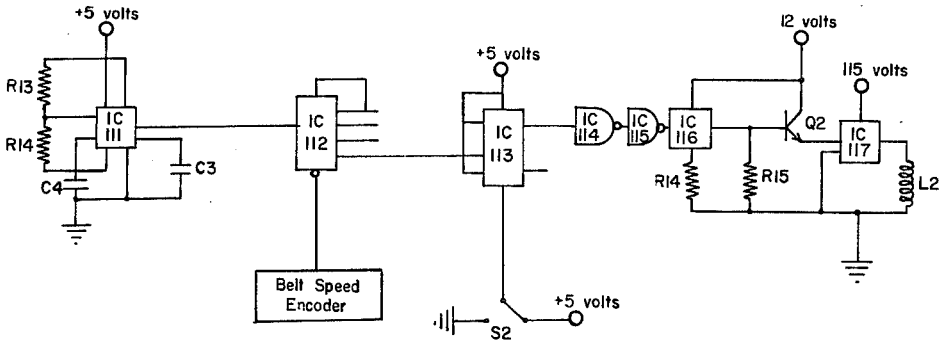

Because the lamps illuminating the illumination area produce a great amount of heat which could burn or overheat the potatoes, it is important that the belt and potato product thereon continue to move through the viewing area without stopping. To protect against such a stoppage, a belt speed encoder 202 is provided to measure the speed of the belt. As shown in FIG. 16, a timer IC111 is connected with capacitors C3 and C4 and resistors R13 and R14 so as to be an oscillator. The output of IC111 is a series of pulses which are an input to counter IC112. The counter IC112 will count the pulses from IC111, and when eight pulses are counted will produce an output to flip flop IC113 causing it to set and produce an output to inverters IC114 and IC115. The output of inverter IC115 is sent to optical isolator IC116, which is connected to produce a voltage across R15 to the base of transistor Q2 upon a positive pulse from IC115. Resistor R14 is a current limiting resistor for the output of IC116. With a positive output from IC115, a voltage appears on the base of transistor Q2 connecting the twelve volts on the collector of transistor Q2 through solid state relay IC117, that is connected so that normally 115 volts AC is provided to relay coil L2 to close contacts (not shown), which close the circuitry to light the viewing area lamps 57. Upon receiving a voltage from transistor Q2, solid state relay IC117 disconnects the 115 volts from relay coil L2, causing the lamps in the illumination area to go out. In order to re-energize the lamps, manual switch S2 is used to reset flip flop IC113.

The circuitry just described is arranged so that the oscillator frequency is such that, under normal operating conditions, the belt speed encoder will reset IC112 before eight pulses from the oscillator are counted. If this is the case, no output will be sent to flip flop IC113 and the lamps will remain energized. If for some reason the belt stops or slows down significantly, so that eight pulses from the oscillator are counted before the belt speed encoder resets counter IC112, the lamps are de-energized.

The inverter IC115 may be a multi-input NAND gate with inputs connected to various sensors, such as temperature sensors located in critical areas of the equipment. The inputs would be normally high, so that, if the signal from any of the sensors went low, the output of IC115 would go high and de-energize the lamps.

The apparatus described could easily remove good pieces from a mass of mostly bad pieces by merely connecting the data signals to the differential line receiver IC22, so that the high output of the receiver occurs for a good item rather than a bad. Further, the camera described is capable of determining other relationships between sensed visible light energy and sensed infrared energy and could activate the circuitry of the invention if other predetermined relationships exist. For example, rather than a data signal being produced when the visible light energy sensed drops below a certain percentage of the infrared energy sensed, the opposite results could be made to produce the data signal, i.e. if the infrared energy sensed is less than a certain percentage of the visible light energy sensed. That and other possible relationships may be useful for sorting products or items other than potatoes.

Although the circuitry specified above is the best presently contemplated, it should be realized that other arrangements and other components may be found desirable from time to time.

Whereas this invention is here illustrated and described with specific reference to an embodiment thereof presently contemplated as the best mode of carrying out such invention in actual practice it is to be understood that various changes may be made in adapting the invention to different embodiments without departing from the broader inventive concepts disclosed herein and comprehended by the claims that follow.

We claim:

1. Apparatus for sorting indiscriminately mixed items, some of which have a predetermined relationship between two mutually different wavelength bands of energy reflected therefrom, and others of which have other than said predetermined relationship, comprising means defining a viewing area; means defining a removal area; means for passing such a mixture into and through the viewing area as a heterogeneous bed, whose thickness is substantially no greater than the thickness of individual items and wherein the individual items are unsegregated, and for passing said bed into and through the removal area after a predetermined amount of time has passed following its passage through the viewing area; means for flooding the viewing area with radiant energy containing the two mutually different wavelength bands in a substantially integrated spread throughout said viewing area; sensing means including a plurality of paired sensing devices focused on the viewing area so as to view corresponding contiguous sub-areas of said viewing area, the paired devices being adapted to sense the two different wavelength bands, respectively, of energy reflected from the corresponding sub-areas; means for comparing the sensed radiant energy of one wavelength band with the sensed radiant energy of the other wavelength band from each sub-area of said viewing area and for producing data signals, respectively, for those sub-areas as to which the predetermined relationship between the sensed energy of different wavelength bands exists; removal means including a plurality of removal devices arranged in side-by-side contiguous relationship across the width of the removal area and comprehending respective portions of said bed along the width thereof which correspond to a plurality of said contiguous sub-areas of the viewing area; and operating means responsive to data signals, for independently operating the removal devices in accordance with a predetermined number of data signals produced for respective corresponding pluralities of contiguous sub-areas of the viewing area, so as to remove from the bed any of said portions thereof which have produced the predetermined number of data signals.

2. Apparatus according to claim 1, constructed so that the predetermined relationship to be detected is the reflectivity of energy of one wavelength band being at least a set amount less than the reflectivity of energy of the other wavelength band.

3. Apparatus according to claim 1, constructed so that one energy wavelength band is located within the wavelength range of visible light energy and the other energy wavelength band is located within the wavelength range of infrared energy.

4. Apparatus according to claim 1, wherein the means for passing the heterogeneous bed through the viewing area and through the removal area comprises a continuous belt conveyor upon which said bed is placed and across which the viewing area and the removal area extend.

5. Apparatus according to claim 1, wherein each pair of sensing devices focused on the viewing area is part of dual diode arrays in which one of the arrays is adapted to sense reflected energy of one wavelength band and the other is adapted to sense reflected energy of the other wavelength band.

6. Apparatus according to claim 5, wherein the means for comparing the sensed radiant energies are adapted to compare the outputs of successive sets of paired diodes.

7. Apparatus according to claim 6, wherein the sensing means focused on the viewing area and the means for comparing the sensed visible and infrared energy are included in a dual diode array, scanning camera.

8. Apparatus according to claim 1, wherein each of the plurality of devices for removing items from the removal area comprises a hollow tube normally held above the removal area and adapted to be lowered by the operating means to removal position where said hollow tube will be connected to a source of vacuum so a corresponding portion of the bed will be sucked through the tube and thereby removed from said bed.

9. Apparatus according to claim 8, wherein the operating means comprises a pneumatically actuated power cylinder and piston device for each removal tube and separably connected therewith.

10. Apparatus according to claim 1, wherein the means for processing the data signals and for controlling operation of the respective removal devices are adapted to cause operation of the respective removal devices a predetermined time period after receipt of data signals, to allow the items represented by the data signals to pass from the viewing area to the removal area.

11. Apparatus according to claim 1, wherein means are provided for de-energizing the means for flooding radiant energy into the viewing area if the means for passing the bed of items through the viewing area stops functioning.

12. Apparatus according to claim 1, wherein the means for passing the mixture is a conveyor belt; the means for flooding radiant energy into the viewing area includes a plurality of lamps, each adapted to produce visible light energy and infrared energy, said lamps being arranged in a utility unit having an operating position above and transversely of the conveyor belt; and wherein means are provided for moving the utility unit from said operating position to a maintenance position at one side of and extending longitudinally of the conveyor belt.

13. Apparatus according to claim 12, wherein the sensing means are located in an upright housing extending upwardly from a position above the viewing area, and the utility unit is normally housed in a downward extension of said housing.

14. Apparatus according to claim 12, wherein the lamps are operatively mounted in elongate electric fixtures disposed within the utility unit and adapted to be moved out of said utility unit to expose said lamps when the utility unit is in the maintenance position.

15. Apparatus according to claim 12, wherein also included are means providing forced fluid cooling for the utility unit.

16. Apparatus according to claim 15, wherein the lamps are mounted in light fixtures extending longitudinally of the utility unit along respectively opposite sides thereof so viewing is between said electric fixtures; wherein stationary, elongate, temperature insulated, cooling boxes are provided for the lamps within the utility unit; wherein said electric fixtures are mounted for swinging movement away from said cooling boxes and include insulating covers, respectively, for said cooling boxes so that the electric fixtures extend within respective, closed, cooling boxes when in operative positions; and wherein the means providing forced cooling for the utility unit include a system for forcing cooling air through the interiors of said cooling boxes and a system for forcing a liquid coolant through the walls of said cooling boxes.

17. Apparatus according to claim 16, wherein each of the electric fixtures comprises a series of spaced insulation blocks mounted in respective receiving openings formed through the insulating cover of the corresponding cooling box, and sets of electrical components mounted in respective insulation blocks, each of said sets of electrical components including a pair of mutually offset bus bars extending through a receiving opening through the corresponding insulation block from outside to inside of the cooling box, a pair of electrical sockets carried by the ends, respectively, of said bus bars that are inside the cooling box, the entrances to said sockets facing in opposite directions, and resilient means constantly urging said bus bars ends in the directions, respectively, in which said extrances to the sockets face; and wherein the lamps are elongate and extend from a socket in one set of electrical components to a socket in a next set of electrical components, the ends of said lamps fitting into and making electrical connections with the opposing sockets between which the respective lamps extend.

18. A method for sorting indiscriminately mixed items, some of which have a predetermined relationship between two mutually different wavelength bands of energy reflected therefrom, and others of which have other than said predetermined relationship, comprising the steps of forming a heterogeneous bed of said indiscriminately mixed items substantially no thicker than the thickness of individual items and in which the items are unsegregated; passing the bed through a viewing area and thereafter into and through a removal area a predetermined amount of time following its passage through the viewing area; flooding the bed with radiant energy containing the two mutually different wavelength bands in a substantially integrated spread throughout the viewing area; individually sensing the reflected radiant energies of said different wavelength bands from contiguous sub-areas across the width of the bed as such bed passes through the viewing area; comparing the sensed radiant energy of one wavelength band with the sensed radiant energy of the other wavelength band from each of said sub-areas to determine whether the said predetermined relationship exists for any of said sub-areas; and removing any portion of the bed along the width thereof which corresponds in location and width with a predetermined plurality of said contiguous sub-areas for which a predetermined number of the predetermined relationships exist.

19. A method according to claim 18, including the additional step of generating a data signal for each comparison of sensed radiant energies that indicates the predetermined relationship is present; and wherein the data signals are processed and used to control removal devices.

20. A method according to claim 19, including the step of delaying the data signals between the time they are generated and the time they are used to control the removal devices.

21. A method according to claim 20, wherein the delay is obtained by cycling the data signals through a revolving memory of a microprocessor.

22. A method according to claim 17, wherein signals proportional to the radiant energies of the respective wavelength bands sensed are produced for each of the sub-areas of the width of the bed and comparisons are made between such signals for generating the data signals.

23. A method according to claim 18, wherein the items forming the indiscriminate mixture are cut pieces of raw white potato, some of which pieces are sound and substantially all white, other of which pieces are defective as evidenced by dark spots.

24. A method according to claim 23, wherein the cut pieces of potato are each of substantially cubical shape whose edges are each about one-half inch in length, and the predetermined plurality of sub-areas occupy a width of about one inch.

* * * * *